US006470581B1

(12) United States Patent
Kolodzieski

(10) Patent No.: US 6,470,581 B1
(45) Date of Patent: Oct. 29, 2002

(54) DUAL CHALK LINE MARKING DEVICE

(76) Inventor: Walter Kolodzieski, 3024 Jones St., Scranton, PA (US) 18505

( * ) Notice: Subject to any disclaimer, the term of this patent is extended or adjusted under 35 U.S.C. 154(b) by 0 days.

(21) Appl. No.: 09/860,387

(22) Filed: May 21, 2001

(51) Int. Cl.[7] ..... B44D 3/38
(52) U.S. Cl. ..... 33/414; 33/1 LE
(58) Field of Search ..... 33/413, 414, 464, 33/756, 760, 764, 1 G, 1 LE

(56) References Cited

U.S. PATENT DOCUMENTS

| | | | | | |
|---|---|---|---|---|---|
| 921,302 | A | * | 5/1909 | Strarr | 33/414 |
| 997,803 | A | * | 7/1911 | Giffen | 33/414 |
| 2,331,298 | A | * | 10/1943 | Bennett | 33/464 |
| 3,046,663 | A | * | 7/1962 | Romero | 33/414 |
| 3,126,637 | A | * | 3/1964 | Short | 33/414 |
| 3,191,308 | A | * | 6/1965 | Lindenau | 33/414 |
| 3,206,855 | A | * | 9/1965 | Fletcher | 33/414 |
| 3,675,735 | A | * | 7/1972 | Bailey | 33/414 |
| 4,473,954 | A | * | 10/1984 | Vilches | 33/1 LE |
| 4,921,507 | A | * | 5/1990 | Beyer | 33/1 LE |
| 5,063,681 | A | | 11/1991 | Bradley | 33/414 |
| 5,212,875 | A | * | 5/1993 | Corso | 33/756 |
| 6,167,632 | B1 | * | 1/2001 | Shor | 33/413 |

* cited by examiner

*Primary Examiner*—G. Bradley Bennett
(74) *Attorney, Agent, or Firm*—Salzman & Levy

(57) ABSTRACT

A dual chalk line marker device having two chalk line spools that are adjustably movable with respect to the housing or base. The spools are adjustable in order to vary the separation width between the chalk lines so that different widths of joist or roofing shingle can be properly marked for disposition upon a work surface.

22 Claims, 7 Drawing Sheets

DUAL CHALK LINE MARKING DEVICE

FIELD OF THE INVENTION

The present invention relates to dual chalk line markers and, more particularly, to an improved, adjustable, dual chalk line marking apparatus that can easily mark chalk lines that vary in their spacing with respect to each other, while eliminating the need for any separate measuring tools.

BACKGROUND OF THE INVENTION

Chalk line marking devices have been found useful in the building, construction, and roofing industries. The roofer often uses a chalk line marker to evenly space shingles upon a roof. In building a house, for example, a construction worker often uses a chalk line marker to accurately space joists and floor supports while securing sheeting.

In one embodiment of the present invention, a chalk line marking device features a double pair of juxtaposed chalk line dispensers that are each affixed to a corresponding base. A chalk line is dispensed from the fixedly spaced dispensers by means of respective crank handles. A stationary ruler is disposed adjacent each dispenser allowing each dispenser to register its position about a work surface adjacent its corresponding ruler. The base is secured once a chalk line position is determined. The chalk lines are deposited upon a work piece by first striking the chalk lines in one position and then sliding the chalk lines to a second position where they are struck again.

In another embodiment, the chalk line dispensers can comprise an internal spring so that the chalk lines can automatically return into the dispenser housing after having been extracted therefrom.

The present invention is based on the discovery that providing an apparatus for easily varying the width of the chalk lines provides a means by which markings can be made for different joist spacing, as well as different sizes of shingles without the use of extraneous tools and/or measurements.

The present invention features an adjustable chalk line device wherein a single pair of chalk line dispensers can be adjustably moved along the base, thus varying the distance between them. The opposite end of the chalk line is secured to an opposite base by a clip against a spring-bias. A built-in ruler is slidably extracted from the base and acts as a guide to position the dispensers with respect to the work surface. The rulers can be locked in place to allow the worker to move the device to a new location, and subsequently strike a new set of chalk lines.

DISCUSSION OF RELATED ART

In U.S. Pat. No. 5,063,681 issued to Bradley on Nov. 12, 1991 for DUAL CHALK LINE MARKER, a dual chalk line marking device is illustrated. The dual chalk lines are dispensed from a spool by a hand crank. The chalk lines are spaced a given, fixed distance apart by a first spreader unit attached to the spool. A second, movable spreader unit is withdrawn from the first spreader unit to advance the dual chalk lines a given distance from the spool.

SUMMARY OF THE INVENTION

The present invention is a dual chalk line marker device. The line marker device comprises a housing or base in which are disposed two spaced-apart spools. Each spool contains a quantity of chalk line and is movable with respect to the housing or base, wherein the width of separation between the chalk lines can be varied easily. A ruler bar unit is movably distanced from the housing and receives the dual chalk lines; a given length of chalk lines can be metered from the housing or base. The distal end of each chalk line comprises a clip that attaches to the ruler bar unit at indexed, slotted stations, which allows the lines to be anchored a predetermined width with respect to the adjustable spools. The spools comprise crank handles for extracting and retracting a given amount of chalk line. They can also be constructed with an internal spring wherein chalk lines can be extracted from the spools against the spring force and will be automatically retracted under the spring biasing.

Both the housing and the ruler bar unit comprise a double-sided ruler that is slidably movable therein in order to extract it. The double-sided rulers allow the dual line chalk marker device to be positioned with respect to a work surface. Both the housing and the ruler bar unit comprise a slot in which a spring biased tab rides. Each tab is attached to its respective double-sided ruler. Depressing the tab allows its respective, double-sided ruler to move within the slot. Releasing the tab locks the respective ruler in place.

It is an object of this invention to provide an improved dual chalk line marker device.

It is another object of the invention to provide a dual chalk line marker device that is adjustable in order to vary the spaced-apart width between the chalk lines, while supplying a means by which successive sets of lines may be struck without aid of a separate measuring device or tool.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components shall bear the same designations and numbering throughout the figures.

DETAILED DESCRIPTION OF THE PREFERRED EMBODIMENT

Generally speaking, this invention features a dual chalk line marker device whose chalk line spools are adjustably movable with respect to the housing or base. The spools are adjustable in order to vary the separation width between the chalk lines so that different widths of joist or roofing shingle can be properly marked for disposition about a work surface.

Figure 1:
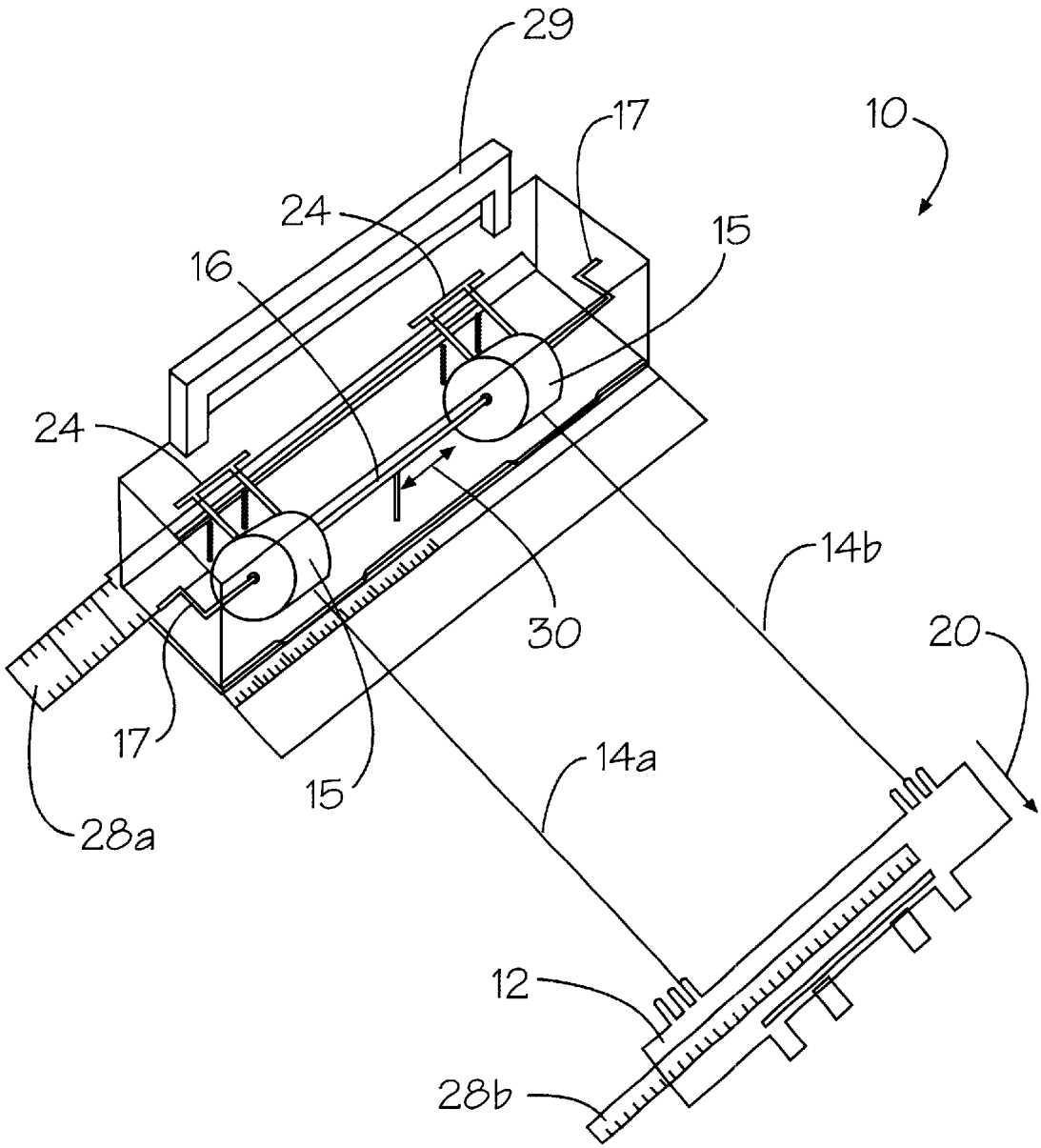
FIG. 1 illustrates a perspective view of one embodiment of the dual chalk line marker device of this invention.

Now referring to FIG. 1, there is shown a first embodiment of a dual chalk line marker device 10 in accordance with this invention. The device 10 comprises a chalk line spool housing 11 and an adjacent ruler bar 12. Spaced-apart, dual chalk lines 14*a* and 14*b* are respectively suspended between the spool housing 11 and the ruler bar 12. A fold-down handle 29 is attached to the housing 11 for purposes of portability.

Two spaced-apart spools 15 respectively store and dispense the chalk lines 14*a* and 14*b* therefrom. The chalk line spools 15 rotate and slide (arrow 30) about shaft 16, shown in greater detail in the enlarged view of FIG. 2. The spools 15 can be spring-biased with respect to the longitudinal axis of shaft 16 in order to allow the automatic dispensing of the chalk lines 14*a* and 14*b*, which can be pulled from the spools 15 without using the crank handles 17. The biasing also allows automatic retraction of the chalk line into the spool 15 after the extended line is released.

Spools 15 can be locked in place by a lever or tab (not shown) after a given length of chalk line is dispensed therefrom. The spaced-apart distance X between the spools 15 can be varied by sliding the spools along shaft 16 (arrow 30), thus allowing the marking of different joist lengths.

Figure 5A:
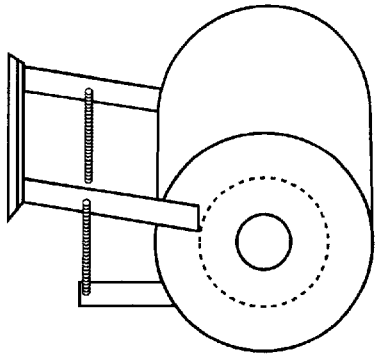
FIG. 5A illustrates an enlarged, perspective view of the spool mechanism shown in FIG. 1.
Figure 5:
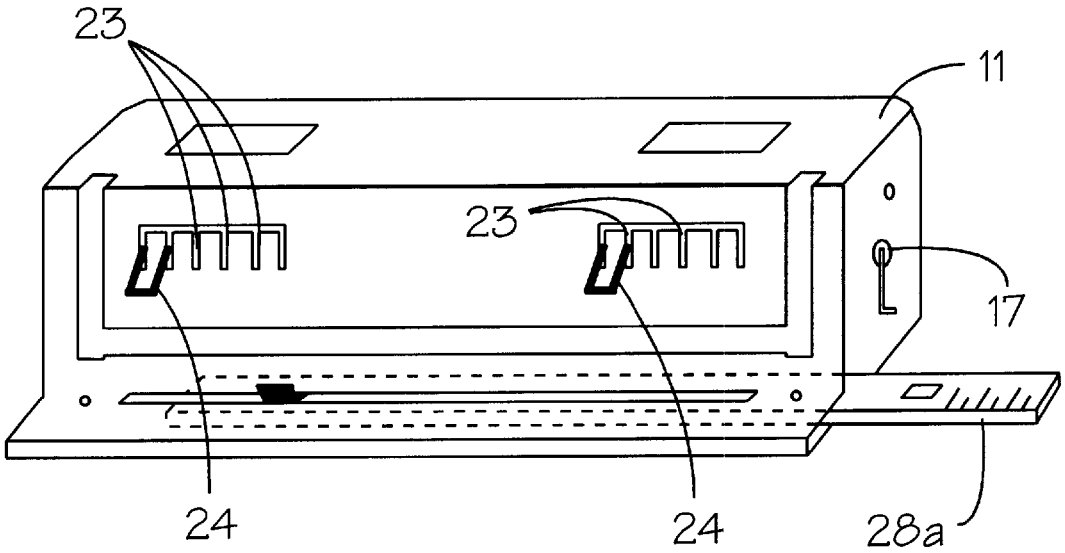
FIG. 5 shows a perspective view of the spool indexing mechanism disposed in the housing of the dual chalk line marker device depicted in FIG. 1.

The indexing or placement of the spools 15 along the shaft 16 is precisely metered by support handles 24 that are placed into receiving index slots 23 disposed along the elongate axis of housing 11, as illustrated in FIG. 5. The support handles 24 are spring-loaded, so that once placed at a particular position, they remain fixed in that position.

The ruler bar unit 12 can be stored within a small hollow compartment (not shown) in the chalk line housing 11, when not in use. The chalk lines 14*a* and 14*b* are respectively attachable and removable from the ruler bar 12, so that the ruler bar 12 can be stored within the housing 11 without fouling the chalk lines 14*a* and 14*b*.

Figure 2:
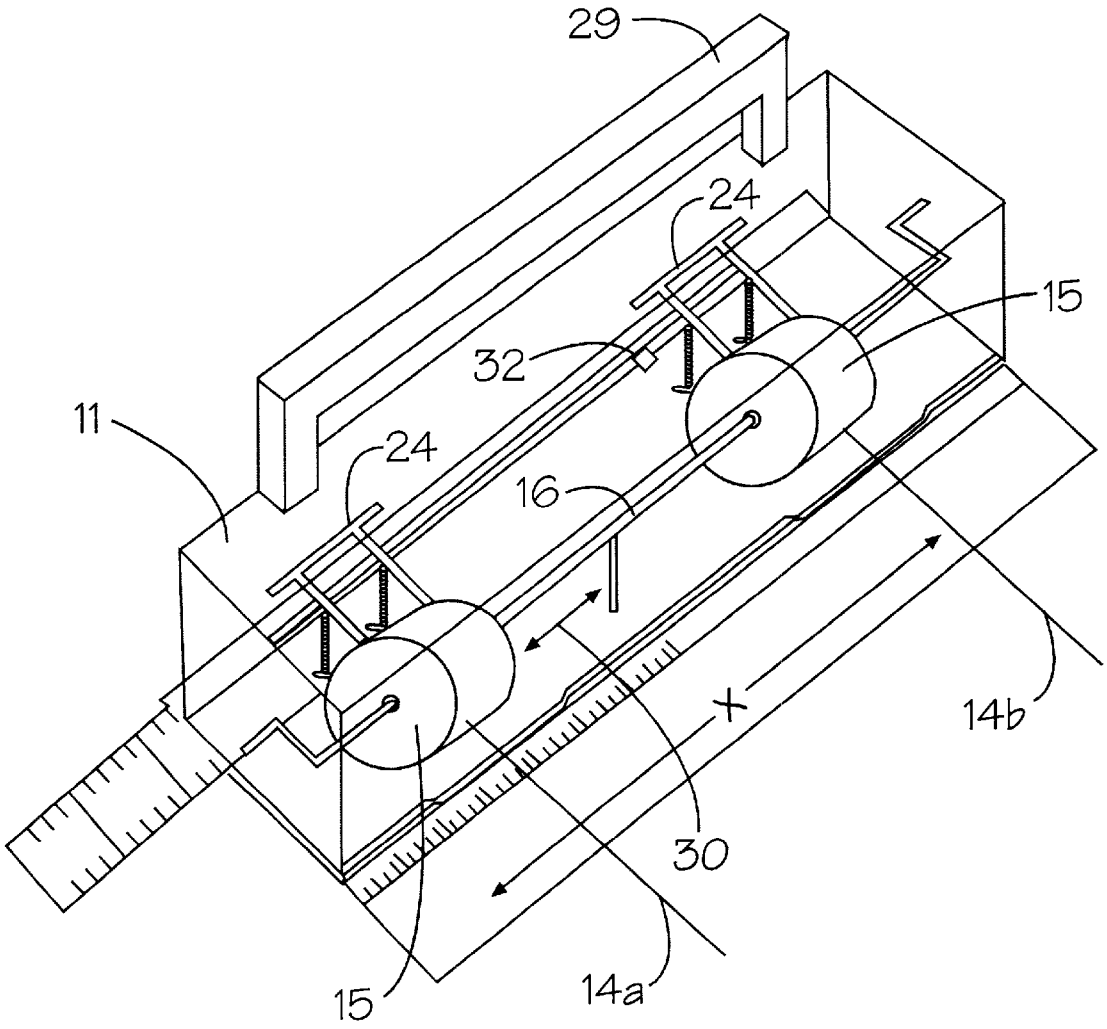
FIG. 2 depicts an enlarged, perspective view of the dual chalk line dispensing housing shown in FIG. 1.

Both the housing 11 and the ruler bar unit 12 comprise slide-out, double sided rules 28*a* and 28*b*. The double sided rule 28*a* is slidable by moving spring-loaded tab 32 within the slot 33 disposed in housing 11, as shown in FIG. 2. Release of the spring-loaded tab 32 locks the ruler 28*a* in the desired position. Ruler 28*b* is slidable by moving spring-loaded tab 36 in the elongated slot 35, similar to ruler 28*a*. Release of the spring-loaded tab 36 locks the ruler 28*b* in the desired position. The slide-out rules 28*a* and 28*b* allow the unit 10 to be positioned with respect to a base line on a work surface.

Figure 3A:
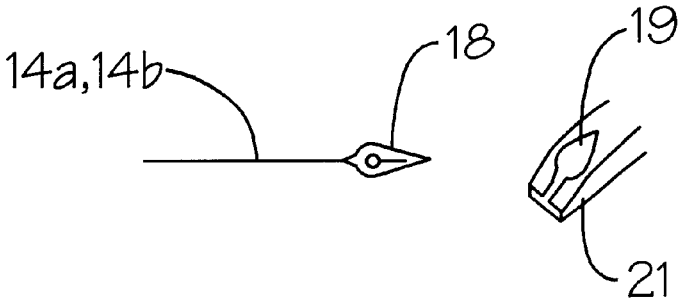
FIG. 3A illustrates a magnified view of the indexing stations disposed upon the ruler bar unit shown in FIG. 3.
Figure 3:
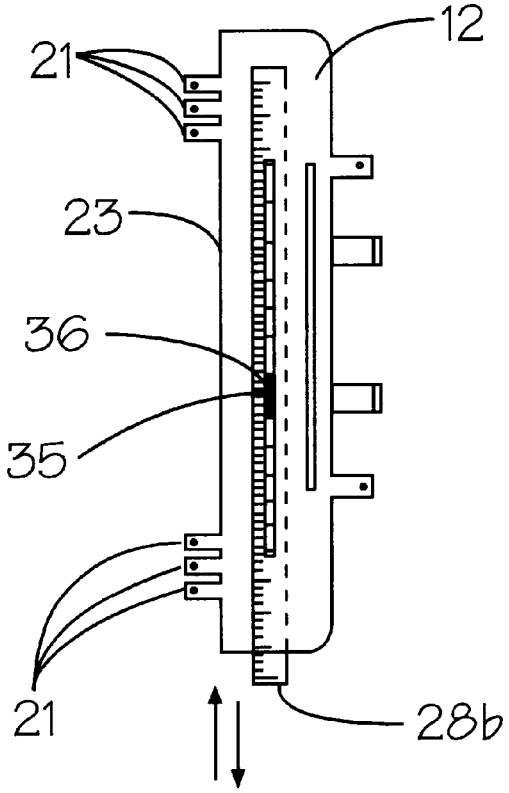
FIG. 3 shows a top view of the ruler bar unit depicted in FIG. 1.
Figure 4:
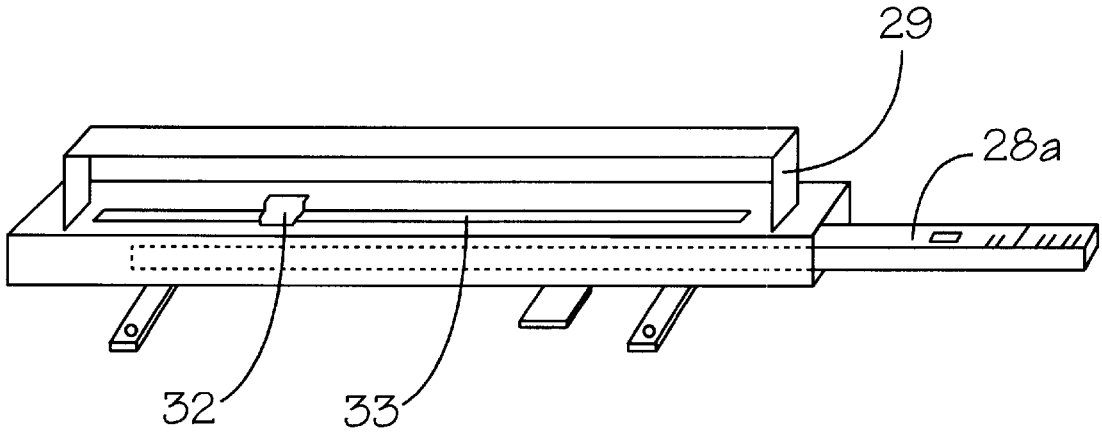
FIG. 4 depicts a perspective view of the tab adjustment mechanism for the double-sided rulers shown in FIGS. 2 and 3.

Referring to FIG. 3A, chalk lines 14*a* and 14*b* each carry a clip 18 on a distal end thereof, that fits into an aperture 19 of one of several indexing tabs 21 disposed along the elongated face 23 of the ruler bar 12, as shown in FIG. 3. The tabs 21 are disposed along elongated face 23 at periodic intervals that match the indexed movement of the spools 15 about the housing 11. In this manner, the chalk lines 14*a* and 14*b* can be maintained parallel to each other.

Figure 6:
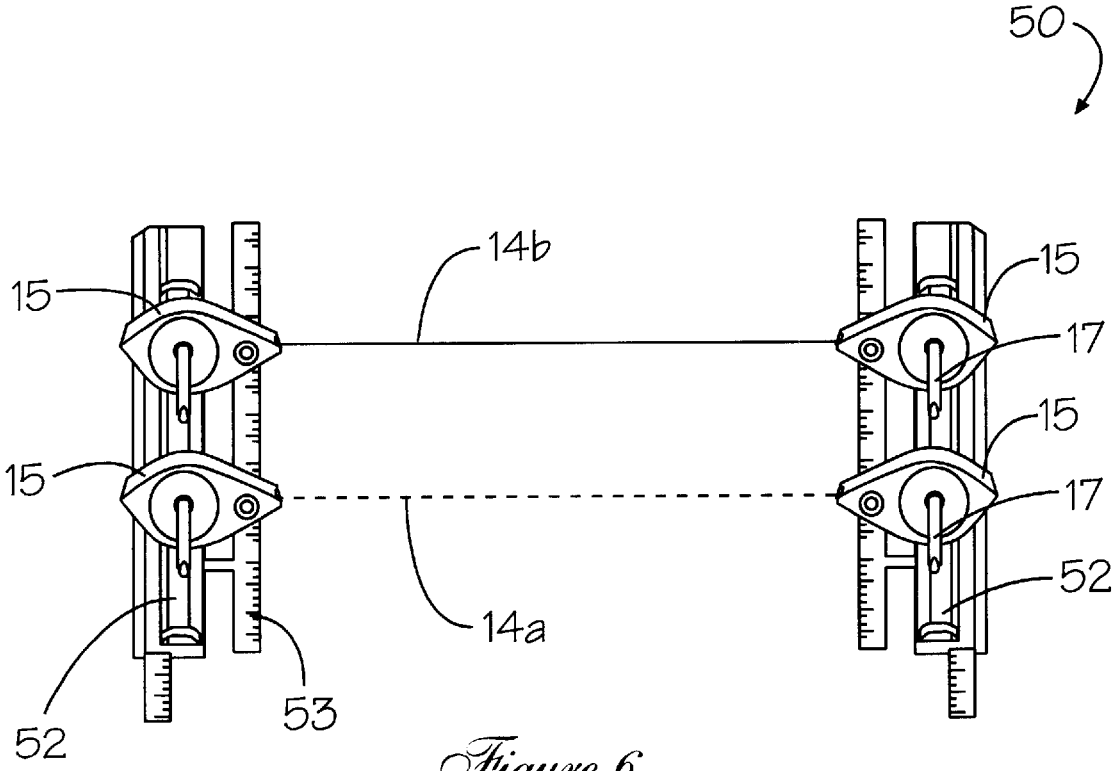
FIG. 6 illustrates a perspective plan view of a second embodiment of the chalk line marking device of this invention.

Referring to FIG. 6, a second embodiment of the dual chalk line marking device 50 of this invention is shown in perspective plan view. In this embodiment, the chalk line dispensing spools 15 are slidably disposed upon a base 52. The handles 17 allow for the extraction and retraction of a given length of chalk lines 14*a* and 14*b*.

Figure 7:
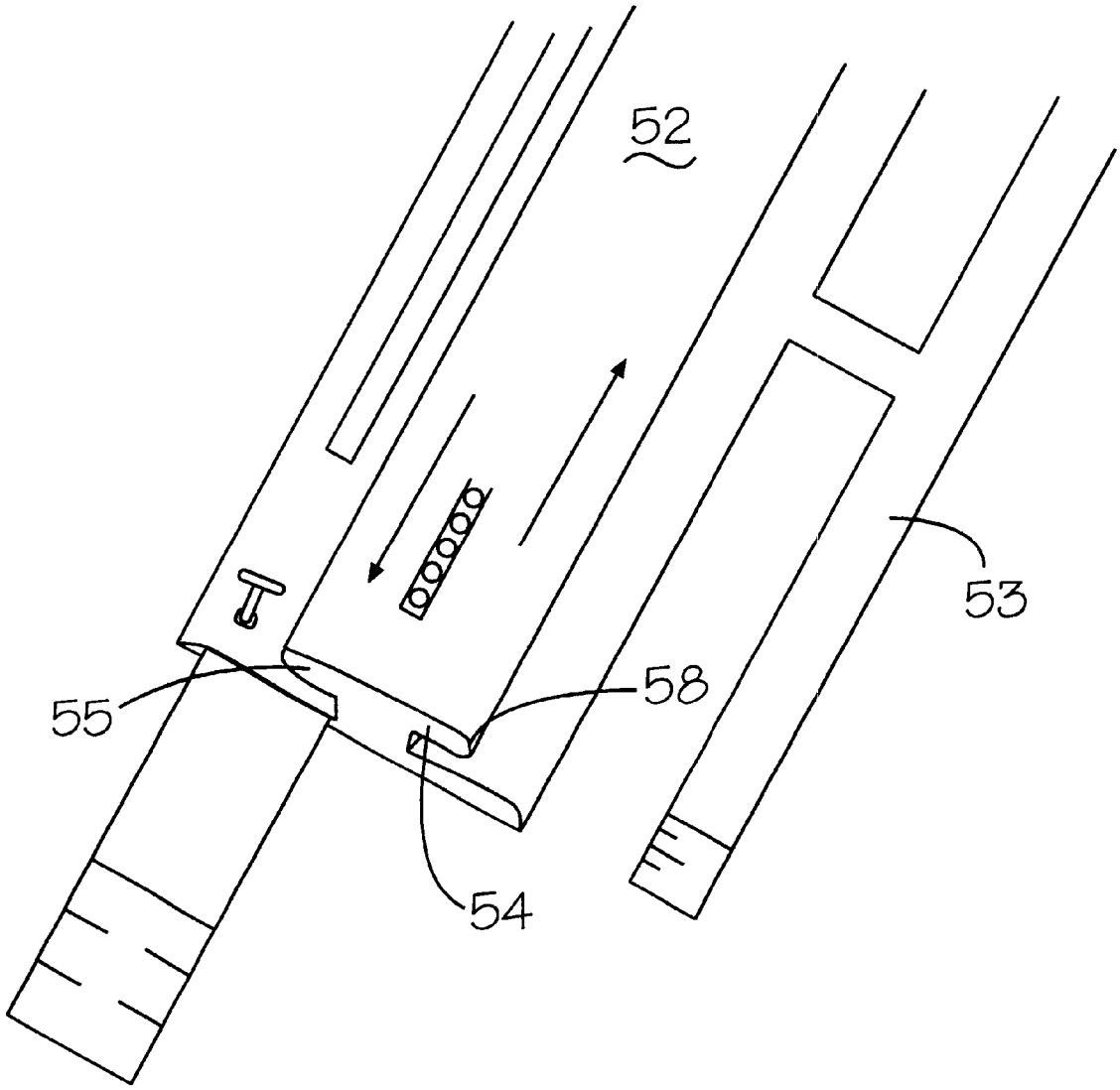
FIG. 7 depicts a perspective, enlarged view of the base section shown in FIG. 6.
Figure 8:
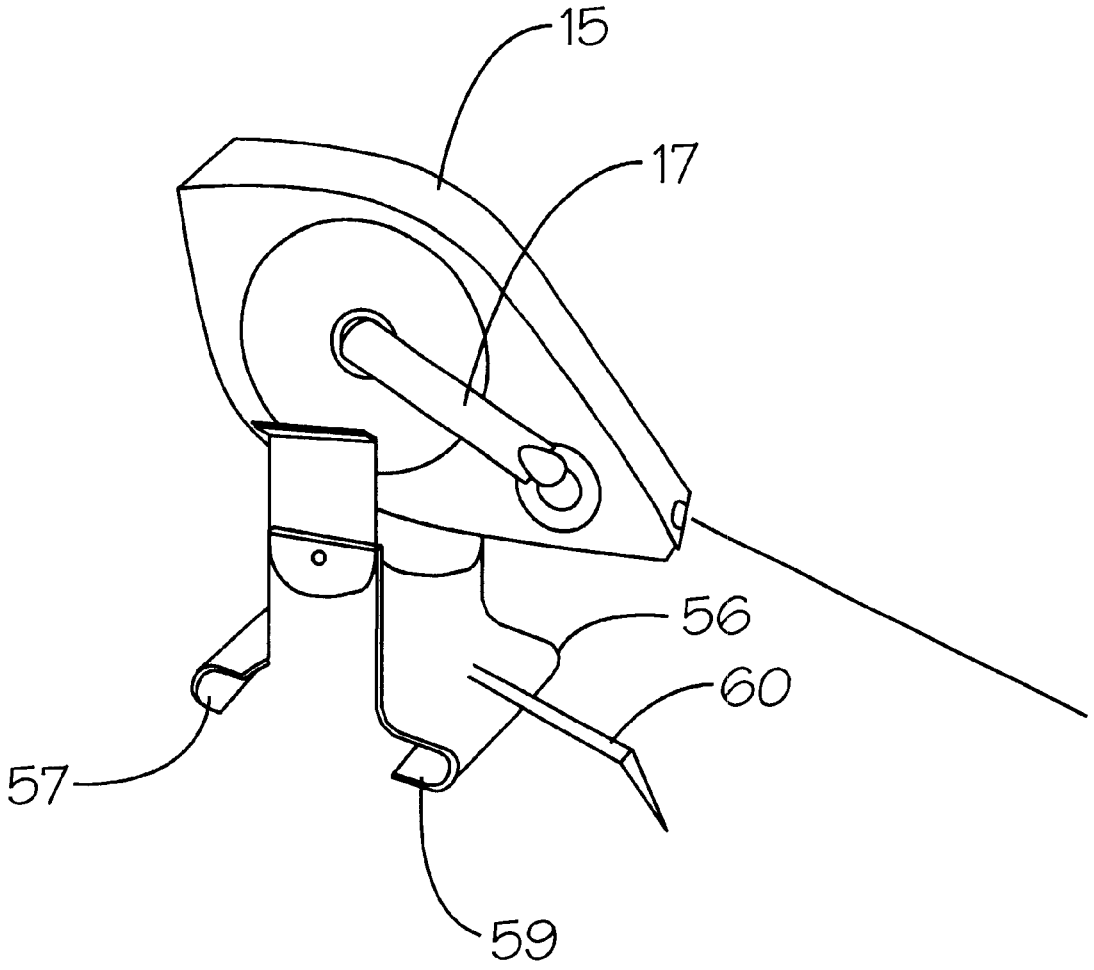
FIG. 8 shows a perspective view of a bracket member supporting a dispensing spool that is slidably captured for movement upon the base section depicted in FIG. 6.

Referring to FIG. 7, an enlarged view of the base 52 of the device 50 is shown. The base 52 comprises a slide track 54 that supports the spools 15 for slidable movement via supporting brackets 56, illustrated in FIG. 8. The brackets 56 have two respective bracketing arms 57 and 59 that conform to, and wrap about the support arms 55 and 58 extending from the support glide track 54. The brackets 56 can have a pointer 60 that rides along the stationary ruler 53, for the purpose of accurately positioning the spools 15.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An adjustable double chalk line marker device, comprising:

a housing containing two movable chalk line spools;

adjustment means disposed within said housing for moving each spool within said housing, said chalk line spools each storing and dispensing a chalk line for marking a work surface, such that two substantially parallel chalk lines are extendable from said housing; and a chalk line receiving member disposed adjacent said housing for receiving the extendable chalk lines from said housing and for maintaining said chalk lines in extended relationship with said housing.

2. The adjustable double chalk line marker device in accordance with claim 1, wherein said chalk line receiving member comprises indexing means for adjusting a position of said chalk lines with respect to said housing.

3. The adjustable double chalk line marker device in accordance with claim 2, wherein said chalk lines are held in substantially parallel relationship with each other by said indexing means.

4. The adjustable double chalk line marker device in accordance with claim 1, wherein said spools comprise a crank handle for extracting and retracting a given amount of chalk line.

5. The adjustable double chalk line marker device in accordance with claim 1, wherein said spools are rotatably spring biased, whereby said chalk line automatically retracts into said spool when released.

6. The adjustable double chalk line marker device in accordance with claim 1, wherein said chalk lines comprise anchoring means for anchoring said chalk lines to said chalk line receiving member.

7. The adjustable double chalk line marker device in accordance with claim 6, wherein said anchoring means comprises a clip fastener.

8. The adjustable double chalk line marker device in accordance with claim 1, further comprising a movable ruler disposed within said housing.

9. The adjustable double chalk line marker device in accordance with claim 1, further comprising a movable ruler disposed within said chalk line receiving member.

10. The adjustable double chalk line marker device in accordance with claim 8, wherein said movable ruler comprises means defining a slot and a movable spring-loaded tab connected to said movable ruler and disposed for slidable movement in said slot.

11. The adjustable double chalk line marker device in accordance with claim 9, wherein said movable ruler comprises means defining a slot and a movable spring-loaded tab connected to said movable ruler and disposed for slidable movement in said slot.

12. An adjustable double chalk line marker device, comprising:

a housing containing two movable chalk line spools;

adjustment means disposed within said housing for moving each spool within said housing a given spaced apart width, said chalk line spools each storing and dispensing a chalk line for marking a work surface, such that two substantially parallel chalk lines are extendable from said housing with said given spaced apart width; and a chalk line receiving member disposed adjacent said housing for receiving the extendable chalk lines from said housing and for maintaining said chalk lines in extended relationship with said housing with said spaced apart width.

13. The adjustable double chalk line marker device in accordance with claim 12, wherein said chalk line receiving member comprises indexing means for adjusting a position of said chalk lines with respect to said housing.

14. The adjustable double chalk line marker device in accordance with claim 13, wherein said chalk lines are held in substantially parallel relationship with each other by said indexing means.

15. The adjustable double chalk line marker device in accordance with claim 12, wherein said spools comprise a crank handle for extracting and retracting a given amount of chalk line.

16. The adjustable double chalk line marker device in accordance with claim 12, wherein said spools are rotatably spring biased, whereby said chalk line retracts into said spool when released.

17. The adjustable double chalk line marker device in accordance with claim 12, wherein said chalk lines comprise anchoring means for anchoring said chalk lines to said chalk line receiving member.

18. The adjustable double chalk line marker device in accordance with claim 17, wherein said anchoring means comprises a clip fastener.

19. The adjustable double chalk line marker device in accordance with claim 12, further comprising a movable ruler disposed within said housing.

20. The adjustable double chalk line marker device in accordance with claim 12, further comprising a movable ruler disposed within said chalk line receiving member.

21. The adjustable double chalk line marker device in accordance with claim 19, wherein said movable ruler comprises means defining a slot and a movable spring-loaded tab connected to said movable ruler and disposed for slidable movement in said slot.

22. The adjustable double chalk line marker device in accordance with claim 20, wherein said movable ruler comprises means defining a slot and a movable spring-loaded tab connected to said movable ruler and disposed for slidable movement in said slot.

* * * * *